US005215298A

United States Patent [19]

Stemmle et al.

[11] Patent Number: 5,215,298

[45] Date of Patent: Jun. 1, 1993

[54] ORBITING NIP SHEET OUTPUT WITH FACEUP OR FACEDOWN STACKING AND INTEGRAL GATE

[75] Inventors: Denis J. Stemmle, Webster; John F. Derrick, Williamson, both of N.Y.

[73] Assignee: Xerox Corporation, Stamford, Conn.

[21] Appl. No.: 903,298

[22] Filed: Jun. 24, 1992

[51] Int. Cl.[5] ..... B65H 29/66

[52] U.S. Cl. ..... 271/65; 271/186; 271/207

[58] Field of Search ..... 271/65, 81, 186, 207, 271/291, 296, 303, 304, 300, 302, 184

[56] References Cited

U.S. PATENT DOCUMENTS

| | | | |
|---|---|---|---|
| 3,917,256 | 11/1975 | Kubasta | 271/65 |
| 4,506,881 | 3/1985 | Hunt et al. | 271/277 |
| 4,712,785 | 12/1987 | Stemmle | 271/187 |
| 4,858,909 | 8/1989 | Stemmle | 271/184 |
| 4,887,060 | 12/1989 | Kaneko | 355/323 |
| 5,031,893 | 7/1991 | Yoneda et al. | 271/65 |
| 5,065,996 | 11/1991 | McGraw et al. | 271/176 |
| 5,098,074 | 3/1992 | Mandel et al. | 270/53 |

FOREIGN PATENT DOCUMENTS 61-295964 12/1986 Japan .

OTHER PUBLICATIONS

*Xerox Disclosure Journal* vol. 17, No. 2, Mar./Apr. 1992, "Orbiting Nip Sheet Control Device" by John F. Derrick, pp. 69–70.

*Primary Examiner*—H. Grant Skaggs

[57] ABSTRACT

A plural mode system of transporting sheets in an output path of a copier or printer to a sheet stacking area, with selectable sheet inversion provided by opposing first and second sheet feeding rollers forming a sheet transporting nip engaging the leading edge of a sheet, by a relative orbital motion of the opposing rollers to progressively pivot the nip and thereby change the angular direction of motion of the leading edge of the sheet. A selection between faceup and facedown stacking of the sheets is provided by selectable orbital motion of the nip. The sheet is inverted for stacking by orbital motions pivoting the nip by greater than 90 degrees with the sheet's leading edge held in the nip, so that subsequently the leading edge of the sheet is moving in a direction substantially different from the direction of motion of the leading edge when the leading edge first entered the nip. For faceup stacking, a movable sheet deflector gate deflects sheets in the output path away from the nip, upstream of said nip, to bypass the nip, and feed those selected sheets directly from the output path into the sheet stacking station without inversion from different upstream rollers.

14 Claims, 3 Drawing Sheets

ORBITING NIP SHEET OUTPUT WITH FACEUP OR FACEDOWN STACKING AND INTEGRAL GATE

Cross-reference is made to commonly filed and commonly assigned U.S. application Ser. No. 07/903,291 now U.S. Pat. No. 5,201,517 by the same Denis J. Stemmle: "Orbiting Nip Plural Mode Sheet Output With Faceup or Facedown Stacking."

The disclosed system provides simple and improved output and stacking of flimsy sheets, such as the paper copy sheets outputted by a copier or printer. A variable sheet redirection path system is provided by a compact variable feeding nip orientation and integral gate system, in particular, for thereby selectively stacking sheets either "faceup" or "facedown" in the same tray, and/or to different selected outputs, without requiring separate, independently activated, plural gating or deflector mechanisms, and with improved sheet output control.

The disclosed sheet output control and stacking system has particular utility or application for improved multi-mode stacking or pre-collated copy output sheets from a copier or printer into output stackers and/or finisher compilers, allowing collated printing and output of simplex or duplex copy sets, and/or forward or reverse page order output. Separate output trays are not required for faceup versus facedown stacking.

In the system disclosed herein, the output path of sheets being stacked may be varied and controlled for improved stacking, and for inverted or non-inverted stacking into an output stacking area. Additionally, the same pivotal nip mechanism may provide selection between different sheet output designations.

In the improvement claimed in this application, the orbiting nip system may be selectively automatically bypassed by the outputted sheets by a gate actuated by that orbiting nip system itself. This is particularly appropriate for a non-inverting mode of sheet stacking. This is accomplished here without requiring any solenoid or other separately electrically or mechanically activated gates or deflectors.

A sheet deflecting gate is disclosed here which is directly mechanically activated solely by engagement with the orbiting nip system itself when the orbiting nip system is rotated into a predetermined position or positions to do so. This gate, when so activated, pivots into the sheet path to the orbiting nip, upstream of that nip, and deflects the sheets away from the orbiting nip into a different output path, e.g., a non-inverting output path. However, this gate, when it is not activated, does not interfere with normal feeding of sheets into the orbital nip system for any other desired nip orbiting operations of that output system.

In the disclosed system, different final exit rollers can be utilized depending on the mode of operation. When the subject gate is actuated, the effective final exit rollers can be exit sheet path rollers upstream of the orbiting nip and directly above the backstop of the stacking area, rather than be the orbital nip rollers, which are desirably overlying the stacking area and slightly downstream of the stacking registration stop or end wall.

The specific exemplary embodiment disclosed hereinbelow also shows a choice or selection of different sheet output paths for different stacking orientations and/or locations with reduced hardware and positive sheet feeding control for reduced jams simply by changing the output angle of the sheet output feeding nip while the sheet is in that feeding nip, without requiring active (solenoid operated) gates, baffles or deflectors for the choices or selections, even for large and tight (small) radius sheet path turns. In this specific embodiment example, a single, variable nip angle, orbital nip sheet feed exit roller system provides several different sheet output modes, which may include a selection between different output, e.g., to a high capacity stacker, a finisher set compiler, a top tray, a duplex return path, a highlight color overlay printing return path, etc. The specific embodiment disclosed herein provides an automatic or operator choice of output stacking from the same output in several different ways, such as: faceup or facedown into a high capacity tray, into a tray facedown on the top of the processor, into a set compiler/finisher facedown, and with a straight paper path for thick sheet materials. [A partially shared compiler/finisher stacker as in Xerox Corporation U.S. Pat. No. 5,098,074, issued Mar. 24, 1992, (D/88157) is disclosed in the example here.]

By way of background, as discussed in the below-cited and various other references, it is known that the selection of faceup versus facedown output stacking is affected by various design limitations, choices and compromises for the copier or printer input, processor architecture, and paper path. First, maintaining page collation of output sets of plural copies, is desirable in most cases. Pre-collated sets printing allows on-line finishing [stapling, gluing or other binding] of copy sets as each collated set is printed. However, maintaining collation is determined by the copying and stacking page order, and the sheet facing (faceup or facedown stacking).

1 to N or forward serial page order copy generation order (and thus a corresponding 1 to N copy output order, except for some limited duplex loop situations) is desirable in many copying and electronic printing applications. It can reduce page buffering and first copy out time delays for electronically transmitted documents. It avoids a precount cycle for collated simplex to duplex copying. It can also simplify job recoveries after jam clearances, etc. The former is discussed, for example, in Col. 4 of Xerox Corporation U.S. Pat. No. 4,918,490, issued Apr. 17, 1990 to the same Denis J. Stemmle.

However, as is well known, 1 to N simplex pre-collation copy sheet output requires facedown output sheet stacking in order to maintain collation of the simplexed output sets. However, facedown output means that simplex output is stacked blank (back) side up, so the operator cannot see what is being printed without turning the sheets over.

Also, most copier or printer processors print each page image onto each copy sheet page inside the machine faceup, for various processor design reasons. That is, the toner image is usually transferred from the photoreceptor or other initial imaging surface to the copy sheet while the copy sheet is substantially facing up [or, in some cases, while it is vertical]. Thus, for a substantially linear paper path, the copy sheets also are normally desirably exited faceup, not facedown. That allows simple, direct, output stacking with collation of simplex copy sheets providing they are printed in N to 1 or reverse page order. Faceup stacking also desirably produces immediate copy image visibility, as noted. N to 1 printed simplex sheets can exit the processor and stack in the order N, . . . 5, 4, 3, 2, 1, faceup, which provides a collated set, 1, 2, 3, 4, 5, . . . N.

As noted, faceup stacking is needed for reverse order or N to 1 collated simplex copy sheet output. N to 1 output is typically provided, for example, for copies made from documents sequentially fed from the bottom of a stack of faceup loaded original documents, as in most recirculating document handlers (RDH's). Faceup stacking may also be desirable even in some special modes of operations of an otherwise 1 to N copier or printer. For example, special modes for proof sheets, or for uncollated simplex output, where it is desired to immediately see the printed side of the copies (faceup) as they exit the processor, without having to manually turn the sheets over. Or, a special mode for avoiding arcuate deflection or curling of stiff or thick paper, by maintaining a relatively linear path, as noted previously.

A substantially linear or planar output from a faceup image transfer to faceup stacking is also possible if duplex copy sheets are being produced in N to 1 or reverse page order, where the duplexed first or odd numbered page sides are printed last (onto the second sides), i.e., N−1 . . . 5, 3, 1, so that page one is faceup land on top of each completed set in the output stack.

If the duplex output is in 1 to N page order, that is, 2/1, 4/3, 6/5, etc., this will be collated if the even sides are printed last in duplexing and output stacked faceup, i.e., with the last-printed even sides 2, 4, 6, etc., faceup, so that in the output stack, page one is on the bottom of each set and facing down.

However, note that another known option or feature is to have a "natural" inversion in the output paper path, so that, for example, sheets may be printed faceup but naturally inverted once before they are finally outputted into the stacking tray, and thus normally stacked facedown [see, e.g., said above-cited U.S. Pat. No. 4,918,490 by the same Denis J. Stemmle]. In that type of output path, an optional inverter in the output path or at the output may invert the sheets a second time to optionally allow them to stack faceup.

Thus, it may be seen that if a copier or printer is to provide a choice of simplex or duplex output, and maintain collation, that a selectable output inversion of one but not the other output may be needed, as variously discussed in the art. Also, it may be seen that whether the simplex sheets or the duplex sheets will be inverted depends on whether the printing page order is 1 to N or N to 1, and which sides of the duplex copies are printed first, and whether the output path has a natural inversion.

Some examples of patents showing means for selectively inverting (or not inverting) copy output sheets just prior to their stacking into an output tray for simplex versus duplex and/or 1 to N versus N to 1 output, with "disk stackers," or other sheet rotators, include Xerox Corporation U.S. Pat. No. 3,917,256, issued Nov. 4, 1975; U.S. Pat. No. 5,065,996, issued Nov. 19, 1991; XDJ publication Vol. 12, No. 3, page 137–8, May/June, 1987 by the same Denis J. Stemmle, and his corresponding U.S. Pat. No. 4,712,785, issued Dec. 15, 1987. Of particular interest here, said XDJ and U.S. Pat. No. 4,712,785 have a separately actuated gate 7, to divert the sheet into a pivotal disk stacker with integrally pivotal exit rollers 32, or into a bypass into different, fixed, rollers 3. (FIG. 2 of U.S. Pat. No. 4,712,785 shows the drives complexity.) Disk stackers have various difficulties, such as initially pushing the sheet into a long passive slot, an unconfined sheet flipping, resultant sheet inertia from flipping all but the sheet's lead edge away from the registration wall, and requisite coordination of lead edge release with the lead edge impact with the registration wall. Also noted was IBM Corporation U.S. Pat. No. 4,506,881, issued Mar. 26, 1985, to R. E. Hunt, et al. E.g., FIG. 3 of said U.S. Pat. No. 4,506,881 shows a change in sheet direction 67, but the nip rolls 23 remain stationary, and the change in sheet direction is accomplished by dropping arcuate baffle or diverter 65 into the downstream nip roll exit paper path, into which the sheet must be pushed. That approach tends to have sheet feeding resistance or buckling, and other difficulties.

Xerox Corporation U.S. Pat. No. 4,858,909, issued Aug. 22, 1989 to the same Denis J. Stemmle has previously taught providing better control over exiting sheets by rotating the relative nip position or angle between exit rollers of a copy sheet output stacker or duplexing tray entrance rollers to change the sheet feeding orientation somewhat during the feeding out of a copy sheet into the tray. The presently disclosed system utilizes some desirable features of the basic orbiting nip concept shown in said U.S. Pat. No. 4,859,909. However, the present system substantially extends the functionality of that concept and introduces new functioning, operating sequences and results. The orbiting nip on the former device (see the FIG. 6 and Cols. 5–6 embodiment of U.S. Pat. No. 4,858,909 [which was also used in the Xerox Corporation "5034" copier duplex path]) remains in a fixed position to drive a sheet of paper into the duplex tray via path "L" if the sheet is the normal "letter" size, or 8.5 inches wide, or less. For larger sheets, (or sheets processed lengthwise—run short edge first) the orbit nip remains stationary for the first few inches travel, but then orbits to direct the trail edge of such longer sheets towards the rear of the receiving tray (see path "P"). The orbit nip then returns to its home position of path "L" to receive the lead edge of the next sheet.

Further distinguishing said Stemmle U.S. Pat. No. 4,858,909, FIG. 6 embodiment, note that the sheet path entrance to duplex tray 63 via feed rolls unit 60 is from the rear end of that tray 63, so that the lead edge of the sheet must be fed from that end at 60 clear to the opposite or registration end of tray 63 (at feed-out end 64). Also, the rotated nip path "P" is for feeding the tail end of a long sheet (only) in the opposite direction, away from feed out end 64. There is only facedown stacking provided there, and no option is provided there of stacking faceup versus facedown. Also note that none of the roller unit 60 nip rotation positions from its solid to its dashed-line position "L" through "P" in FIG. 6, are directing the sheet to a different stacking position. They are all directed downwardly into duplex tray 63. Particularly note that for the non-stacking, immediate duplex loop path 62 option, a solenoid actuated deflector gate 61 is required there. Besides the added complexity, as may be seen, there is the possibility of interference between the separate gate 61 and the separate orbiting nip 60, if either is misoperated. The FIG. 1 and FIGS. 2–4 embodiments of said Stemmle U.S. Pat. No. 4,858,909 are for (only) inverting the output for (only) facedown stacking using a generally vertical compiler and stacking tray, with an additional moving corrugation tongue 21. This FIG. 1–4 embodiment utilizes less than 90 degree nip orbiting. However, stacking is more complicated than in a normal, and more desirable, generally horizontal stacking tray with a less than 45 degree vertical inclination, as shown herein. Also, note from FIG. 5 that the cross-frame 44 could block or cross the paper path if that orbital unit was rotated too far.

The drawing of recent *Xerox Disclosure Journal* Publication Vol. 17, No. 2, March/April 1992, p. 69–70, entitled, "Orbiting Nip Control Device", incidentally partially shows, but does not describe, part of the basic concept of the present invention in showing an additional optional feature of one way fiber climbing prevention material on the stacking tray registration wall by the same John F. Derrick.

Other rotating nip angle systems, used for redirecting a copy sheet path, are disclosed in Japanese published Patent No. 61-295964 to Ohashi (Canon) filed Jun. 21, 1985 as App. No. 60-136718, and U.S. Pat. No. 4,887,060 to Kaneko, (Japanese priority 1986), noted in a preliminary search.

The searcher indicated that said U.S. Pat. No. 4,887,060 to Kaneko discloses, inter alia, a sheet discharge device having a movable member 110 comprising two pairs of rollers, i.e., first rollers 106 and second rollers 107, which are in pressure contact with each other (column 8, line 53–55). First rollers 106 are driven by a sheet carry motor 116, and second rollers 107 rotate freely (see especially FIG. 10). With the lead edge of a sheet pinched between the rollers 106 and 107, the second rollers 107 can redirect the direction of travel of the sheet by being epicyclically driven by motor 124 (see, e.g., FIG. 9) around the first rollers 106 (see especially, FIGS. 10, 11, 12 and 14). In the embodiment shown in FIG. 13, the rollers 106 and 107 are used to selectively discharge sheets to either a first paper discharge tray 208 (on the side of the device) during a continuous copy mode or a second discharge tray 209 (on top of the device) during an interrupt copying operation (column 11, line 1–70 and column 12, line 1–16).

Said Japanese published Patent No. 61-295964 (abstract) to Ohashi discloses a system having a feed roller 46, and two secondary rollers 47*a* and 47*b* which are movable by a solenoid between two portions with the top of the circumference of the feed roller 46. In a first position, the secondary feed rollers direct a sheet to an exit route 39, and in a second position, the secondary rollers redirect a sheet to a return route 40 for duplex copying. See FIGS. 1 and 3.

Further by way of background, in the prior art, outputted sheets are often effectively flow or thrown into the tray from one end thereof. That is, normal output stacking is by ejecting sheets high above one end of the top sheet of a stack of sheets onto which that ejected sheet must stack. Typically, each ejected sheet travels generally horizontally and planarly, primarily by inertia. That is, the sheet is not typically effectively controlled or guided one it is released into the open stacking tray area, and must fall by gravity into the tray to settle onto the top of the stack, which is resisted by the high air resistance of the sheet in that direction. Yet, in a high speed copier or other imager, sheet stacking must be done at high speed. Thus, a significant disadvantage of that type of stacking is that light-weight sheets of paper, in particular, have a relatively long settling time. The dropping or settling of a generally horizontal sheet is resisted by its large air resistance if it is being urged down onto the top of the stack only by its relatively very small gravitational force.

Further by way of background, the stacking of sheets is made more difficult where there are variations in thickness, material, weight and condition (such as curls), in the sheets. Different sizes or types of sheets, such as tabbed or cover sheets or inserts, may even be intermixed in the same copy sets in some cases.

Various general problems of sheet restacking, especially the setting of an ejected sheet onto the top of the stack, are well known in the art in general. Some examples of various output restacking assisting devices are taught in Xerox Corporation U.S. Pat. Nos. 5,005,821; 5,014,976; 5,014,977; 5,033,731; and art therein. Such art includes document restacking in a recirculating document handler (RDH). One approach to improving control over RDH tray document restacking is shown in Xerox Corporation U.S. Pat. No. 4,469,319, issued Sep. 4, 1984 to F. J. Robb, et al. It teaches variable corrugation of the sheets, which corrugation is increased as the sheet ejection rollers and associated baffles are moved back horizontally with the rear wall of the tray to accommodate larger dimension sheets in the tray. The patent also teaches flexible sheet deflecting or knockdown flaps 100, 101, 102 at the sheet ejection position. U.S. Pat. No. 5,076,558, issued Dec. 31, 1991 to M. J. Bergeron, et al., also utilizes such flexible deflecting flaps (142), plus air pressure somehow directed at the ejected sheets (141). Xerox Corporation U.S. Pat. No. 4,436,301 to M. S. Doery, et al., further discusses restacking difficulties and has an overstack vacuum transport and mechanical bail lead edge knockdown system. However, such sheet "knock down" systems tend to undesirably deflect down prematurely the lead edge of the ejected sheet. Also, such "knock down" systems can interfere with sheet stack removal or loading and can be damaged thereby. Stacking control systems desirably should not interfere with open operator access to an output stacking tray or bin.

Also, the sheet ejection trajectory may have to accommodate variations in the pre-existing height of the stack sheets already in the tray (varying with the set size and sheet thickness) unless a tray elevator is provided. The trajectory should also accommodate the varying aerodynamic characteristics of a rapidly moving sheet, which can act as an airfoil to affect the rise or fall of the lead edge of the sheet as it is ejected. This airfoil effect can be strongly affected by fuser or other curls induced in the sheet. Thus, typically, a relatively high restacking ejection upward trajectory angle must be provided. Otherwise, the lead edge of the entering document can catch or stub on the top of the sheet stack already in the restacking tray, and curl over, causing a serious jam condition. [Further discussion of such restacking problems, and others, in an RDH, is provided, for example, in U.S. Pat. No. 4,480,824, issued Nov. 6, 1984, on a document tray jam detection system.]However, setting a sufficiently high document trajectory angle to accommodate all these restacking problems greatly increases the sheet settling time for all sheets, as previously noted, and creates other potential problems.

On another background subject, art on reversing the feeding direction of exit feed rolls while they are holding the sheet trail edge, for sheet reversal for a duplex return path for duplex (both sides) printing, is cited and discussed in Xerox Corporation U.S. Pat. No. 5,014,976, issued May 14, 1991 to D. C. Muck, et al. See, e.g., art cited in Col. 2. See also the above-cited U.S. Pat. No. 4,858,909 FIG. 6 showing reversing exit rollers 58 with sheet paths E, F, G and H.

As to specific hardware components which may be used with the subject apparatus, or alternatives, it will be appreciated that, as is normally the case, various such specific hardware components are known per se in other apparatus or applications, including the cited references and commercial applications thereof.

The disclosed apparatus may be readily operated and controlled in a conventional manner with conventional control systems. Some additional examples of various prior art copiers with document handlers and control systems therefor, including sheet detecting switches, sensors, etc., are disclosed in U.S. Pat. Nos. 4,054,380, 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute such control functions and logic with conventional software instructions for conventional microprocessors. This is taught by the above and other patents and various commercial copiers. Such software may, of course, vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional together with general knowledge in the software and computer arts. Controls may alternatively be provided utilizing various other known or suitable hard-wired logic or switching systems. The controller signals may conventionally actuate various conventional electrical solenoid or cam-controlled deflector fingers, motors or clutches in the selected steps or sequences as programmed. Conventional sheet path sensors, switches and bail bars, connected to the controller, may be utilized for sensing and timing the positions of documents and copy sheets, as is well known in the art, and taught in the above and other patents and products. Known copying systems utilize such conventional microprocessor control circuitry with such connecting switches and sensors for various functions, and need not be described herein.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus the present invention will be better understood from this description of an embodiment thereof, including the drawing figures (approximately to scale) wherein:

Figure 1:
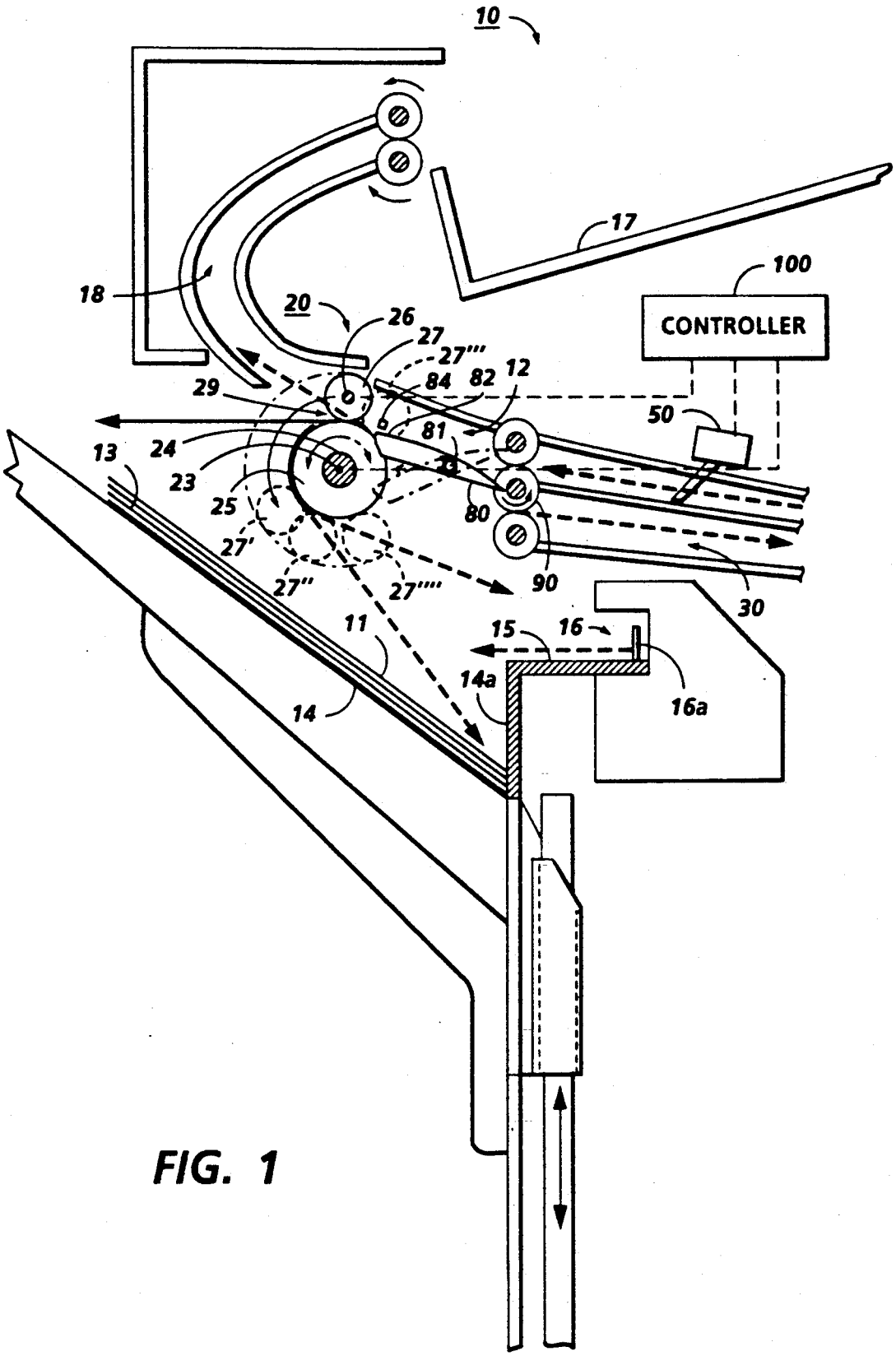
FIG. 1 is a schematic front view of one exemplary copy sheet output system incorporating one example of the present plural mode movable nip angle sheet output control and stacking system with an exemplary integral self-actuating bypass gate, showing different operating positions and alternate outputs selectable thereby.

The present invention is not limited to the specific embodiment illustrated herein. Referring particularly to FIG. 1, there is shown one example of a plural mode sheet output system 10, where a single, unitary orbiting nip system 20 (with a single nip 29), at the single output 12 of a copier or printer, provides all output sheet 11 and stacking 13 selection and control.

This disclosed embodiment transports sheets to a sheet receiving area or station for stacking. For sheet inversion, it uses opposing first and second sheet feeding rollers forming a sheet transporting nip, by engaging the leading edge of a sheet delivered to the nip, by feeding the sheet partially through this nip, and producing a relative orbital motion of the opposing rollers to progressively pivot the nip, and thereby change the angular direction of motion of the leading edge of the sheet while the sheet is feeding through the nip. [That is done to a limited extend in the above-discussed prior Stemmle U.S. Pat. No. 4,858,909.]

Here, the orbital motion of the opposing rollers to pivot the nip further includes plural mode selectable operation of the pivotal motion to provide plural output selections, including faceup or facedown stacking of the sheets in at least one receiving tray, such as 14, as follows. In a first selected operating mode, the leading edge of the sheet is inverted as it is in the nip 29 by a first selected orbital motion of the nip sufficient to effectively reverse the direction of motion of the leading edge of the sheet. In a second selected mode, the sheet is not inverted and can be fed to stack relatively linearly without inversion, by automatically actuating a nip bypass sheet deflector gate 80 deflecting outputted sheets directly down into the sheet stacking tray 14 without inversion.

The disclosed embodiment also provides other selective, different, modes of operation with different nip orbits, with different orbit distances and angles, or end points, to selectively direct sheets to either a finisher/-compiler, or a stacker (faceup or facedown), or a top tray, or other selected outputs. For example, in a disclosed third selectable mode, a third selected motion of the nip here pivots the nip further than the first mode to feed the sheet into the sheet set compiling and finishing area at least partially separate from the sheet receiving tray. In all of these plural selectable modes of operation, the initial pivotal angle position of the nip is preferably substantially the same for the initially engaging of the leading edge of sheet being delivered to the nip, which may be, for example, substantially horizontal.

There is shown in this selectable outputs system 10 example, closely adjacent the orbiting nip system 20, for optionally being fed sheets therewith, a high-capacity elevator type stacking tray or stacker 14, a compiler entrance shelf 15 to a compiler/stapler station 16, and a top tray 17 with a natural inversion path 18 thereto. Into the selected tray (or bin) 14, 15 or 17, individual sheets 11 from the copier or printer output 12 are fed sequentially by the orbiting nip system 20 to be stacked in a sheet stack, such as stack 13 shown here in tray 14. Additionally shown in this example is a duplex and highlight color return path 30, as yet another selectable output path which can utilize two more different operating modes of the same orbiting nip system 20.

All of the selectable stacking stations or areas 14, 16, 17 here are desirably generally horizontal stacking surfaces with a less than 45 degree vertical inclination conventionally optimized for stacking end registration. They are not highly vertical trays with stacking properties compromised for inversion, and susceptible to sheet collapse or curling down, as in many prior art inverted output stacking trays.

As noted, the amount of nip orbiting is different for the various desired outputs, i.e., the compiler station 15, 16 versus the stacker station 14 versus the top tray 17 via path 18 versus path 30, etc., as variously shown in the other Figures.

Figure 3:
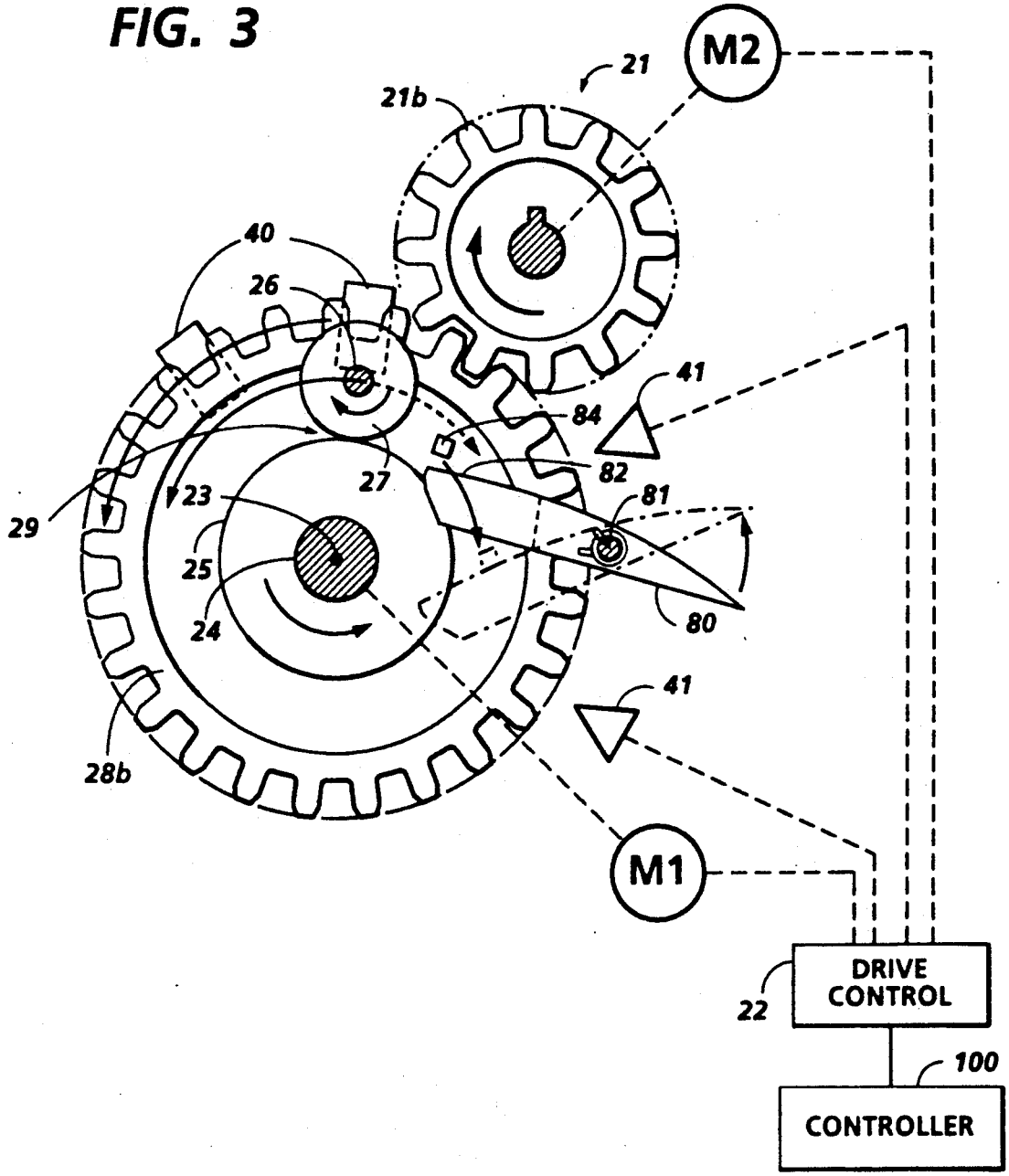
FIG. 3 is a cross-sectional end view of the exemplary nip orbiting apparatus of FIG. 2, showing in the phantom position thereof the actuation thereby of the exemplary bypass gate.

In the orbiting nip system 20 mechanism example here, referring particularly to the enlarge FIG. 3, this entire unit 20 is selectively pivoted about a single fixed central pivot axis 23, defined by shaft 24, by a stepper motor M2 drive 21. That is, the orbiting nip system 20 here may selectably be rotated by an otherwise conventional stepper motor M2 drive 21 to automatically control and move the sheet ejecting or trajectory angle and position. The orbiting nip 29 is formed between central, axial, drive rollers 25 and shaft 24 and orbiting idler rollers 27. The orbiting unit 20 carries and provides orbiting of a shaft 26 carrying this orbiting roller 27 about the fixed axis 23, and thereby orbitally about axial drive rollers 25, to thereby orbit and pivot the plane of the nip 29 between these rollers 25 and 27. As noted, the central axis 23 here is also the axis of the drive shaft 24 for these driven output rollers 25.

These feed rollers 25 are separately driven by a motor M1, which may run constantly at a constant speed for a constant sheet output nip velocity. Preferably, as here, the only set of rollers which is driven is this stationarily mounted roller set 25, on fixed axis 23. That greatly reduces drive system complexity. M1 can simply be fixedly mounted to rotate one end of the fixed axis shaft 24 here. Alternatively, shaft 24 could be driven by any other suitable drive. It need not be driven directly by a dedicated motor. E.g., it could be conventionally clutched to the main drive chain of the copier or printer.

In this orbital nip system 20 example, this nip 29 orbiting is accomplished by mounting the idler roller shaft 26 between two end gears 28 which are effectively forming end frames of the orbital unit 20 [see below]. The axis of shaft 26 is mounted parallel but spaced from the central axis 23 so that the idler rollers 27 may rotate about, but maintain contact with, the other rollers 25. This orbiting of the rollers 27 may be done while the rollers 25 are being independently rotated on their own shaft 24 to provide driven copy sheet output. By this orbiting and feeding at or approximately at the same angular velocity, the lead edge of a sheet may be held within the nip 29 while the nip 29 is orbiting without interrupting the normal sheet output movement. This positive lead edge nip control allows tight radius, (around the rollers radius 25), large angle turns of the exiting sheet. If normal passive deflectors were used instead, such small diameter sheet turns would be very jam prone, especially for light weight sheets.

Nor does the system 20 here tend to induce a problem-inducing degree of curl or set in the sheet even in such a highly arcuate (180° or more) small radius turn. Only a small area of the sheet (virtually a line contact) is pressed in the nip with rollers 25 at any particular moment, and all the adjacent portions of the sheet can assume a larger radius than roller 25.

Further to this particular example of the orbital unit 20 [of which there are other possible mechanical alternatives, such as modification of the FIG. 5 embodiment of said U.S. Pat. No. 4,858,909] the stepper motor M2 drive 21 includes two spur gears **21*a* and 21*b* on a common drive shaft. Each spur gear engages and holds or drives one respective large diameter end gears or gear segments 28*a* and 28*b*, which connect together the unit 20 at each end and provide the end bearings for shaft 26. The end gears 28 are outside of the paper path and are freely rotatably mounted to shaft 24 so as to rotate about but not rotate with, shaft 24. Thus, the gears 28 together are freely rotatable about the central axis 23. Rotation of gears 28*a* and 28*b* with drive 21 by spur gears 21*a* and 21*b* pivots the entire unit 20 about its pivot axis 23, thereby pivoting the engagement position and angle between the rollers 27 and 25 to pivot the nip 29**.

This nip orbiting is shown in FIG. 1 by the difference between the solid line and the dashed line positions of the different roller 27 positions 27, 27', 27'', 27''', 27'''', etc., and the corresponding different sheet ejection paths shown with respective sheet ejection directional arrows. The orbital movement for these different examplary modes is varied to different, respective selected end positions as explained herein. That is, different orbital motions are provided for the different sheet outputs 14, 15, 18 and 30, and also for inverted stacking in tray 14 by sheet inversion, as shown.

The sheet stacking system 10 stepper motor M2 drive control 22 may be actuated and controlled by a conventional copier controller 100 simply by providing a different, preset, pulse count to drive control 22 for each said selected output mode. The controller 100 may be conventionally connected and controlled for the particular output mode selection by operator switch input selection and/or dependently on the particular output page order and whether or not simplex or duplex is selected, as discussed supra and in the cited references. The corresponding nip 29 orbit motion is thus timed uniquely for each of said output path options. The start and stop times of the M2 applied pulses determines the start and stop times of the nip orbiting. The total number of motor M2 applied pulses determines the amount or degree of orbiting. The stepper motor M2 applied pulse rate determines the orbiting velocity. The orbital velocity may be, in some modes, a constant, so that the nip 29 moves at the sheet 11 velocity provided by rollers 25 to cause the lead edge to move with the nip, as discussed above. However, a variable velocity is desirable in some cases, e.g., for the subsequent nip positions for the inverted stacking mode, as discussed above and below. A sheet path 12 lead edge sensor 50 as shown in FIG. 1 may provide the orbital start after a preset time delay allowing the nip 29 to fully acquire the lead edge of the sheet. [As shown in FIG. 3, tabs such as 40 actuating positional or limit switches 41 may be provided for additional motion limit protection or as an alternative to stepper pulse counting control.]

Since M1 may be a constant velocity drive, the sheet output path sensor 50 also can be used conventionally to start a timer or controller clock pulse count to tell where the sheet lead edge is at all times, including when the lead edge has reached stacker backstop **14*a***, for example.

Turning now to a first mode of operation, for sheet inversion and inverted stacking here the orbiting nip unit 20 begins a counterclockwise orbit motion here as soon as the lead edge of the sheet 11 is acquired by the nip 29. This action escorts within the moving nip 29 the sheet's lead edge around the outside diameter of driver rollers 25 for approximately 135 degrees, effectively turning the sheet over and reversing its direction of motion. This initial nip 29 orbiting may be at a constant velocity approximately equal to the rollers 25 surface velocity, and thus at approximately the same angular velocity. This initial nip orbiting action then stops with rollers 27 at position 27'. The rollers 25 then continue to drive the sheet 11 slightly further until the sheet's lead edge contacts the adjacent rear (inside) registration backstop or end wall 14a of the stacker station 14, if inverted sheet stacking into tray 14 was selected.

If further operations on the output sheets such as compiling into sets, tamping, stapling, hole punching, annotation or other operations are desired, a further mode of operation may be selected. In this further mode here, the nip 29 is orbited slightly further (for example, to a position 27'' of approximately 180 degrees) before orbiting is stopped, so that sheet lead edge is fed into the entrance 15 of the compiler/finisher station 16 and fed on until the sheet's lead edge reaches the compiler backstop, here the set eject fingers 16a of the compiler station 16.

Note that these registration stop surfaces 14a or 16a are closely adjacent the nip 29 so that the sheet does not have to feed unsupported for much of its total length before it reaches registration. This is provided by mounting unit 20 over and closely adjacent these inboard registration ends of these two stacking areas, not their opposite ends, and using what are effectively initially downhill stacking slopes in these modes.

In either of these two above inversion stacking modes, once the lead edge of the sheet 11 has contacted the selected backstop or registration edge 14a or 16a in the stacker station or compiler, the orbital unit 20 is then restarted but reverse driven by drive 21 so that nips 29 now orbits in the reverse (clockwise) direction, using a different orbital speed profile (depending on the particular tray geometrics) that enables the remaining, trailing edge portion of that same sheet to be driven in a continuously changing direction to roll onto, or unscroll onto the stack 13. After nip 29 thus reverses back to its home or original sheet entrance position, this reverse orbit motion is stopped, and the remainder of sheet 11 is then fed out of the nip in an essentially horizontal leftward direction. When the trail edge of the sheet passes through the nip 29, this released sheet end flips out over the outer end of the stack 13 in the outer end area of stacking tray 14. At this point, sheet inversion into the stacker or compiler is completed. The orbiting nip system is already back in the proper position to receive the next sheet from output 12. This orbiting, orbit stopping, return orbiting, and orbit stopping sequence is repeated for each sheet of the set to be stacked inverted. That can provide proper collation for a 1-N sequenced printer simplex output 12, in this particular example.

To redescribe this above operating mode for inverted or facedown stacking in tray 14 or compiler 16, after the forward 135 or more degree orbit of the nip 29 carrying the sheet lead edge is completed, (at positions 27' or 27'') the orbit motion is briefly halted by stopping stepper motor M2 for a time period sufficient for the sheet's lead edge to be driven by rollers 25 and motor M1 into the backstop or registration wall of the stacker tray 14 or compiler station 16. Then, while continuing the M1 drive in the same direction of rotation, the nip orbit is reverse driven by stepper motor M2 at a rate profiled to roll the rest of sheet 11 out onto the top of the stack 13 (as also shown per se in FIG. 6 of U.S. Pat. No. 4,858,909).

This combined operation reduces sheet scatter (misaligned stacking) and sensitivity to curl that is inherent in conventional methods of stacking. At all times, right up to trail edge release, the sheet is under the direct control of the nip 29 between exit rollers 25 and 27, and that variable nip angle is variably aiming the feeding sheet down towards its desired stacking position at that point in its stacking.

The downwardly rolling on of the sheet onto the top of the stack (rather than dropping or sliding) also avoids air being trapped under the sheet which resists settling and contributes to incoming sheet misregistration relative to the stack. Also, it does not pull the sheet away from its registration wall. This is in contrast to conventional sheet stackers, as previously described, using a conventional fixed, and usually uphill aimed, output nip. There, the sheet simply drops, and then free floats, down onto the stack in an uncontrolled fashion, and depends on gravity to slide back into stack alignment, thus contributing to slow and uneven settling and scatter in the stack, and reducing stack capacity with curled sheets.

Turning now to the operating modes where sheet inversion by the orbiting nip unit 20 is not required, in the second mode here, for, e.g., N-1 sequenced prints, or for uncollated heavy card stock or envelopes output (where a straight paper path is preferred), the output sheet is deflected or guided by gate 80 so as to be driven past (bypass) the nip 29. The sheet thus remains in the same facing orientation and in a substantially linear path directly ejecting into the stacker 14 faceup, similar to conventional sheet stackers. This may be desirably accomplished here by a simple cam mechanism on the orbiting nip unit 20 engaging a pivoting gate such as 80. Gate 80 may be an otherwise conventional set of pivotal sheet path deflector fingers or a moving baffle plate.

The gate 80 pivots about its own axis 81 (spaced from the orbital unit 20 axis 23) when it is actuated by a connecting or integral cam follower surface 82 being engaged by an suitable camming surface of the pivotal orbit unit 20, such as cam 84 here, when the orbiting nip unit 20 is rotated into the position preselected to do so. Here, that is where that idler rollers 27 are in position 27'''. In this example, that is the extreme clockwise orbit position of the orbital unit 20. Here in this example, no other orbital position of the unit 20 actuates the gate 80. I.e., gate 80 is normally out of the sheet path to the nip 29 except in that position. That is, cam 84 pushes on cam follower surface 82 to pivot gate 80 into the sheet output 12 path (thereby deflecting all subsequently fed sheets away from nip 29 and directly down into tray 14) only when orbital unit 20 rotates into position 27'''. It will be appreciated that gate 80 could be actuated by other suitable means.

To summarize, in that non-inverting mode of operation, the orbit nip rotates to position 27''' furthest clockwise from its normal or home position, and that orbital motion is used to directly mechanically actuate deflector gate 80 for sheets to bypass the nip 29 and go directly into the tray 14. This arrangement eliminates any need for any electromechanical actuators, such as a solenoid, for any output path gates. The same nip orbiting system of the other operating modes also actuates this gate 80, in at least one preselected orbital positions thereof.

Note that when gate 80 is activated, the final output sheet feeding rollers engaging the sheets in the output 12 path are the upstream feed rollers 90, located directly above the stacking tray 14 and its registration wall 14a. The downstream rollers 25 and 27 forming the orbiting nip 29 are the final sheet feeding rollers only when the gate 80 is not activated.

Other selectable output paths in this example, which are also selected solely by different nip orbiting positions of the unit 20, will now be further described. As shown, for optional, alternative output stacking in the top tray 17, the nip 29 is rotated slightly by approximately 30 degrees clockwise here, until the orbiting rollers 27 are stopped just prior to position 27'''. This points the nip 29 (and thus, the lead edge of the sheet 11 passing through the nip 29) upwardly into the baffles of the path 18 to the top tray 17. As shown, this path 18 here has a natural inversion so that sheet 11 fed therethrough is turned over to stack facedown in this top tray 17, in this particular example. For this mode the nip may be orbited and stopped before it acquires a sheet. It can stay in that position as long as tray 17 is used.

Turning now to two additional optional output features disclosed here, they both use a single combined duplex and highlight color return path 30. The highlight color mode is selectable here by rotating the orbital unit 20 (while carrying the lead edge of the sheet in nip 29) to a maximum counterclockwise position before orbiting is stopped. The orbiting idler rollers 27 are stopped in position 27'''. The rollers 25 then continue to feed the sheet, into path 30. This accomplishes inversion of the outputted sheet 11, just as previously described for nip 29 positions 27' and 27'' for stacker 14 and compiler 16. However, in this case, the lead edge of the sheet is carried further, more than 180 degrees around the driven rollers 25, to be aimed and fed into the return path 30, rather than being stacked. Thus, the sheet is fed back with inversion to the processor. With the further internal inversion typically provided for reentrance to the transfer station of the processor, the sheet will have two inversions. Thus, a second image, such as a highlight color image may be placed on the same side of that same sheet and the sheet may then be normally exited back out through the output path 12 for selectable stacking as described in any of the previous modes of operation. This can be automatically done for each sheet for which highlight color or other overprinting is selected.

For duplexing rather than same side or highlight color printing, the same return path 30 may be utilized, but preferably there is a different orbiting nip operation. For duplexing, preferably the nip 29 is not rotated from its normal position at output path 12 until after the trail edge area of the sheet is in the nip 29. Then the orbital nip unit 29 may be rotated slightly clockwise until the nip 29 orbits the trail end of the sheet directly adjacent the entrance to the return path 30. Then (or just before orbiting), the driven rollers 25 are reversed, by reversing the motor M1, so that the sheet is driven back into this return path 30 without having been stacked or inverted in the output area. Thus, when the sheet is forwarded on to the above-noted conventional natural inversion in the duplex path within the processor [as shown in the above-described prior art for this type of exit roller reversal duplexing system], the sheet will arrive at the transfer station of the processor inverted only once, ready to receive its second side image. Then the duplexed sheet may exit into the output path 12 for stacking, with or without inversion, as provided by the orbital nip unit 20 for that duplex output sheet.

An integral or related copy set stapler or other finisher can be provided as disclosed in U.S. Pat. No. 5,098,074, issued Mar. 24, 1992 by Barry P. Mandel, et al. Alternately, or additionally, station 16 could be utilized for compiling and ejecting sets without stapling, or for hole punching, annotation, bar code labeling, or other operations performable on either single sheets or sets.

It will be appreciated that the various optional outputs shown, their entrance positions, and their orientations are merely exemplary and will depend on the particular desired features and overall unit design, as previously noted. However, it is desirable, as is illustrated, that for all of the various outputs of nip 29, that the path entrances or tray initial stacking positions be located relatively closely adjacent to the nip 29 of the exit rollers 25, 27 so as to minimize the unsupported or cantilevered path length of the sheet after the sheet is fed out of the nip 29. This also provides for a more compact overall output station 10.

It may be seen that there is provided in this system 10 example herein selectable 1-N or N-1 faceup for facedown stacking, without adding separate actuating mechanisms for gates or other such devices to the paper output path. This system is space efficient in that the same stacking tray may be used for both faceup and facedown operation. As noted, this system also has utility for copiers in which the stacking orientation is desired to be faceup for simplex and facedown for duplex, or vice versa.

Figure 2:
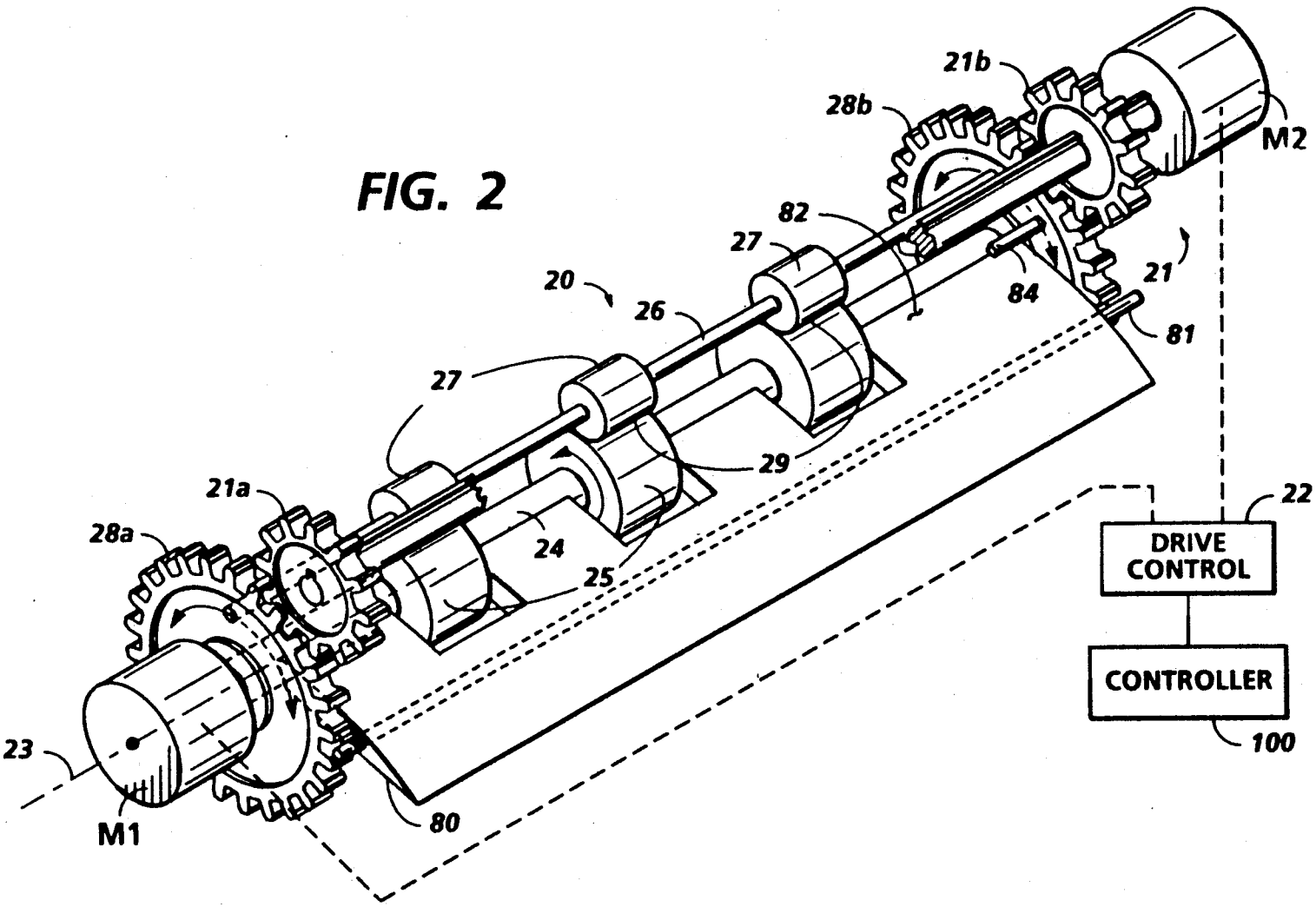
FIG. 2 is a perspective view of one exemplary apparatus for the orbital nip movement unit for the system of FIG. 1.

Note that this present system does not actually require any elevator mechanisms or moving floors for the stack of sheets. The stacking tray 14, or other stacking tray, can be a simple fixed bin or tray such as top tray 17 here. However, a conventional tray elevator and stack height sensor to keep the top of the stack at an approximately constant level can be provided, if desired, as is well known. This is illustrated by the movement arrow associated with tray 14 here, and various patents such as EK U.S. Pat. No. 5,026,034, FIG. 2.

It will be appreciated that generally it is preferably to have as the main output tray of a copier or printer such a repositionable floor stacking tray, as shown herein, and as further described in the above referenced U.S. Pat. Nos. 5,098,074 or 5,026,034. Such a tray provides a relatively constant stacking input position height regardless of the accumulated stack height, thus providing more dependable stacking of large (thick) stacks, as well as small stacks of only a few sheets, particularly for an unattended or higher speed machine. If, however, as noted, one wishes to use a simple fixed position tray or bin with the disclosed orbital nip inversion, then, for that alternative, there is a suggestion of said John F. Derrick, for overcoming upward bucking or stacking registration problems with that fixed tray alternative only. [In fixed tray stacking, the distance from the nip to the backstop impact position for the lead edge of the incoming sheet will, of course, vary with the stack height.] This is to aim the lead edge of the entering sheet with the orbital nip to hit high up on the registration stacking wall (backstop), at the maximum intended stacking level for that fixed tray, even if the tray is empty, and to compensate for the tendency of the lead edge to either buckle from being overdriven against it when the tray is full, or to pull away from the registration wall as it drops (swings) down into the stacking corner from that initial level if the tray is empty, by starting the reverse orbiting of the nip when the lead edge is about 10 mm from the backstop and reverse orbiting the nip at an orbital velocity of about one-half (0.4 to 0.6) of the forward feeding movement velocity of the sheet. Thus, even if the lead edge of the sheet initially misses the stacking corner when the tray is nearly empty, it will be driven into registration because it has net forward velocity due to said reduced reverse orbiting velocity. If the stack was full, upward bucking is avoided, because of said starting of the reverse orbiting of the nip before the lead edge hits the backstop. As many as 750 sheets have been stacked in this manner in a fixed tray.

It will be appreciated that a printer can be a facsimile machine or A multifunctional machine including facsimile capability. Such machines may print on the bottom face of the sheets and/or want face down output for security reasons.

As an optional, additional feature of the disclosed system, if there is no tray elevator, the conventional control logic in the controller 100 can be used to count the total number of outputted sheets since the tray was last emptied to provide an approximate determination of the stack 13 height, and provide corresponding control signals in response thereto. These may be fed here to the control 22 for the stepper motor drive 21 to effect a corresponding slight change in pivoting of orbital unit 20, so as to maintain the sheet output trajectory angle as low as practicable.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In an apparatus for transporting generally flimsy sheets in an output path in a first direction of motion downstream towards a sheet stacking station, for stacking the sheets, including opposing first and second sheet feeding rollers forming a sheet transporting nip for engaging the leading edge of a sheet delivered to said nip and then feeding the sheet through said nip, with means for producing a relative orbital motion of said opposing rollers for pivoting the feeding angle of said nip;

the improvement comprising means for selectable plural mode sheet outputs;

wherein said means for selectable plural mode sheet outputs includes a movable sheet deflector gate, movable into and out of said output path upstream of said nip, and wherein said means for producing a relative orbital motion of said rollers includes means for actuating said movable sheet deflector gate to deflect sheets in said output path away from said nip upstream of said nip to bypass said nip by a selected orbital motion of said nip actuating said movable sheet deflector gate into a position for deflecting sheets in said output path away from said nip.

2. The sheet transporting and stacking apparatus of claim 1, wherein said sheet deflector gate deflects sheets directly from said output path into said sheet stacking station without inversion when said nip is pivoted into a preselected said feeding angle by said selected orbital motion of said nip.

3. The sheet transporting and stacking apparatus of claim 1, wherein said selectable plural mode sheet outputs are controlled by selectable operation of said means for producing a relative orbital motion of said rollers, and includes a selection between faceup and facedown stacking of the sheets from said sheet output path into said sheet stacking station by, in a first said selected mode, engaging the leading edge of a sheet delivered to said nip, and inverting the leading edge of the sheet as it is held in said nip during a first initial orbital motion of said nip pivoting said nip sufficiently to effectively reverse said first direction of motion of the leading edge of the sheet, for inverting the sheet, and, in a second said selected mode, not inverting the sheet, by said actuation of said sheet deflector gate by a different said selected orbital motion of said nip.

4. The sheet transporting and stacking apparatus of claim 3, wherein said second selected orbital motion of said nip in said second selected mode is in an opposite direction of orbital motion from said first initial orbital motion of said first selected mode.

5. The sheet transporting and stacking apparatus of claim 4, wherein said sheet deflector gate deflects sheets directly from said output path into said sheet stacking station without inversion when said nip is pivoted into a preselected said feeding angle by said selected second orbital motion of said nip.

6. The sheet transporting and stacking apparatus of claim 1, wherein in a first selected mode, a first selected orbital motion of said nip pivots said nip substantially more than 90 degrees with said sheet held in and moving with said nip so that after said first selected orbital motion, said leading edge of the sheet is moving in a direction substantially opposite from the direction of motion of said leading edge when said leading edge first entered said nip, and is inverted.

7. The sheet transporting and stacking apparatus of claim 1, wherein said sheet stacking station has a sheet stacking registration end, and said first and second sheet feeding rollers forming said nip are mounted over said sheet stacking station slightly downstream of said registration end thereof, and wherein there is a separate upstream set of sheet feeding rollers providing the final sheet feeding rollers when said sheet deflector gate is activated, and wherein said upstream set of sheet feeding rollers are positioned approximately above said sheet stacking registration end of said sheet stacking station.

8. The sheet transporting and stacking apparatus of claim 1, wherein at least one of said first and second rollers forming said nip is mounted in a rotatable orbiting nip unit, and said orbiting nip unit includes means for mechanically engaging and pivoting said movable sheet deflector gate into said output path when said orbiting nip unit is rotated into at least one preselected said orbital motion position.

9. The sheet transporting and stacking apparatus of claim 1, wherein said deflector gate is moved into said output path by a selected orbital motion of said nip sufficient to mechanically engage said deflector gate to provide said movement of said deflector gate into said output path.

10. The sheet transporting and stacking apparatus of claim 1, wherein at least one of said first and second rollers forming said nip is mounted in a rotatable orbiting nip unit, and said orbiting nip unit includes means for mechanically engaging and pivoting said movable sheet deflector gate into said output path when said orbiting nip unit is rotated into preselected orbital motion position by a selected orbital motion of said nip sufficient to mechanically engage said deflector gate to provide said movement of said deflector gate into said output path.

11. In a method of transporting sheets in an output path to a downstream sheet stacking area with opposing first and second sheet feeding rollers forming a sheet transporting nip, including engaging the leading edge of a sheet delivered to said nip while producing a relative orbital motion of said opposing rollers to pivot said nip and thereby change the angular direction of motion of the leading edge of the sheet while the sheet is in said nip;

the improvement wherein said step of producing said orbital motion of said opposing rollers to pivot said nip further includes plural mode selectable operation of said orbital motion to provide at least a selection between faceup and facedown stacking of the sheets in the sheet stacking area by, in a first said selected mode, inverting the leading edge of the sheet as it is in said nip by a first selection orbital motion of said nip;

and in a second said selected mode, not inverting the sheet, by moving a deflector gate into said output path upstream of said nip to deflect sheets away from said nip and to deflect the sheet into a sheet stacking area without inversion wherein said moving of said deflector gate into said output path is done by a second selected orbital motion of said nip sufficient to mechanically engage said deflector gate to provide said movement of said deflector gate into said output path.

12. The method of transporting and stacking sheets of claim 11, wherein in said first selected mode, said first selected orbital motion of said nip pivots said nip greater than 90 degrees with sheet held in said nip and moving therewith, so that after said first selected orbital motion, said leading edge of the sheet is moving in a substantially different direction from the direction of motion of said leading edge when said leading edge first entered sand nip, and is inverted.

13. The method of transporting and stacking sheets of claim 11, wherein said selectable plural mode sheet outputs are provided entirely by different selectable orbital motions of said rollers, and includes a selection between faceup and facedown stacking of the sheets from said sheet output path into said sheet stacking station by, in said first selected mode, inverting the sheet by inverting the leading edge of the sheet as it is held in said nip during a first initial orbital motion of said nip pivoting said nip sufficiently to effectively reverse said first direction of motion of the leading edge of the sheet, and, in said second selected mode, not inverting the sheet by said actuation of said sheet deflector gate by a different said selected orbital motion of said nip.

14. The method of transporting and stacking sheets of claim 11, wherein at least one of said and second rollers forming said nip is mounted in a rotatable orbiting nip unit, and said orbiting nip unit mechanically engages and pivots said movable sheet deflector gate into said output path when said orbiting nip unit is rotated into a preselected orbital motion position by a selected orbital motion of said nip sufficient to mechanically engage said deflector gate to provide said movement of said deflector gate into said output path.

* * * * *